US012227267B1

(12) United States Patent
Alhazza et al.

(10) Patent No.: US 12,227,267 B1
(45) Date of Patent: Feb. 18, 2025

(54) AUTOMATIC BOAT DOCKING SYSTEM

(71) Applicant: KUWAIT UNIVERSITY, Safat (KW)

(72) Inventors: Khaled Alhazza, Safat (KW); Shaikha Shams Aldeen, Safat (KW); Dalal Anwar Aloudah, Safat (KW); Salwa Fares Alazmi, Safat (KW); Hayat Bader Albassam, Safat (KW)

(73) Assignee: KUWAIT UNIVERSITY, Safat (KW)

( * ) Notice: Subject to any disclaimer, the term of this patent is extended or adjusted under 35 U.S.C. 154(b) by 0 days.

(21) Appl. No.: 18/214,508

(22) Filed: Jun. 26, 2023

(51) Int. Cl.
*B63B 21/20* (2006.01)
*B63B 21/00* (2006.01)

(52) U.S. Cl.
CPC ..... *B63B 21/20* (2013.01); *B63B 2021/006* (2013.01)

(58) Field of Classification Search
CPC ..... B63B 21/20; B63B 2021/006
See application file for complete search history.

(56) References Cited

U.S. PATENT DOCUMENTS

| | | | | |
|---|---|---|---|---|
| 3,033,152 A | | 5/1962 | Letourneau | |
| 3,336,896 A | | 8/1967 | Burnett | |
| 3,463,114 A | * | 8/1969 | Lovell | E02B 3/20 114/230.16 |
| 3,763,816 A | | 10/1973 | Wilson, Jr. | |
| 5,499,591 A | | 3/1996 | Chippas | |
| 5,676,085 A | | 10/1997 | Michl, Jr. | |
| 8,408,153 B2 | * | 4/2013 | Montgomery | E02B 3/20 114/230.17 |
| 11,618,629 B2 | * | 4/2023 | Buel | B66C 11/16 414/277 |

FOREIGN PATENT DOCUMENTS

| | | | | |
|---|---|---|---|---|
| CN | 110716555 A | * | 1/2020 | |
| CN | 218703738 U | * | 3/2023 | |
| CN | 114761316 B | * | 10/2024 | B25J 15/0616 |
| ES | 2064206 B1 | | 7/1998 | |
| JP | 5291113 B2 | * | 9/2013 | B63B 21/00 |
| WO | WO-2006006879 A1 | * | 1/2006 | B63B 21/00 |

* cited by examiner

*Primary Examiner* — Anthony D Wiest
(74) *Attorney, Agent, or Firm* — Nath, Goldberg & Meyer; Joshua B. Goldberg

(57) ABSTRACT

A mooring device, mechanism, system and method for automatic boat docking. The automated boat docking system has a mooring device installed at a marina or at a boat ramp. The mooring device will have a rod installed, with a suction valve at the end of an arm connected to the rod. The suction valve is used to hold the boat in place. Once the suction valve is connected to the boat, the rod will move, and the arm will rotate the boat to where the boat will be docked or lifted safely.

19 Claims, 6 Drawing Sheets

AUTOMATIC BOAT DOCKING SYSTEM

BACKGROUND

1. Field

The disclosure of the present patent application relates to boat docking. More specifically, it relates to an automated boat docking system.

2. Description of the Related Art

Many accidents occur from the collision of boats with each other while parking, or from the collision of a boat with the marina while docking. Typically, such accidents occur through certain incorrect parking procedures as carried out by the sailor of the boat. In addition, other problems may occur, for example, while lifting a boat by car trolly at the boat ramp due to high waves, severe fog, and/or high winds. Moreover, someone else is needed to help solve these problems, namely docking the boat in the marina and lifting the boat at the boat ramp.

Typically, when docking, a boat is first positioned with a tug so that one end thereof is located adjacent the drydock opening and its length aligned with the length of the basin. Next, hauling lines are taken from aboard the ship and attached to hauling capstans to provide motive power for the ship. Lines from the bow of the ship are then taken as it nears the end of the dock and the lines are manually walked along the rim of the dock to a suitable location where they are temporarily secured to bollards and cleats, with tension applied to these lines selectively to control the direction and speed of the boat's entry to the basin. New lines are taken successively from the boat as it moves into the dock.

This operation is unsatisfactory from several standpoints. One of the most outstanding disadvantages is the excessive manpower required. Further, during the alignment stage, it is impossible for a single individual to keep both ends of the boat under observation at all times, with the result that fore and aft alignment of the boat may be difficult. As such, this common practice consumes undue time and effort, and makes it difficult to control the boat during a time of excessive waves.

Certain solutions to solve these problems have been suggested previously. One such solution is the use of "spider car washers", small robotic spiders that climb and wash cars. The spiders have a small water tank. While the spider moves around the car, the car will be dried by small towels attached to the spider arms. However, these spider car washers are expensive and require a lot of maintenance.

Further, some engines can dock the boats without any human help, but these engines are typically used for yachts, not for small boats, and are very expensive. Moreover, a mechanism with ropes, called MYOR, can pull the boat. In this mechanism, a piece of metal is attached and fixed to the marina. This piece is connected to a large plastic plate where it has ropes. When the driver arrives, the boat can be tied by these ropes and pulled to reach the right place for parking. However, this mechanism is not practical because the driver must tie the rope very well to be effective. Further, this solution has a complicated design and many design parts.

U.S. Pat. No. 3,974,794 discloses an elaborate installation of many various components, including a motor driven vacuum pump. Once the pump creates a vacuum in the oversized vacuum cups attached to a large ship, the towing of the large ship commences. However, this solution is not designed to be used in small boats. Further, permanent brackets or devices are required to be attached to the boat.

Thus, an automated docking system solution solving the aforementioned problems is desired.

SUMMARY

The presently disclosed subject matter relates to an automated boat docking system solution to help boat drivers by saving time and effort, thereby protecting the boats from accidents.

In one embodiment, the present subject matter relates to an automated boat docking system having a mechanism installed at a marina or at a boat ramp. According to certain embodiments, the mechanism will have a rod installed, with a suction valve at the end of an arm connected to the rod. The suction valve is used to hold the boat in place. Once the suction valve is connected to the boat, the rod will move, and the arm will rotate the boat to where the boat will be docked or lifted safely.

In another embodiment, the present subject matter relates to a mooring device for automatically docking a boat, the mooring device comprising a suction valve mounted to an arm, with the arm connected to a track via a rod and a plate, wherein the suction device catches and holds the boat, after which the arm rotates 90 degrees, followed by the arm, rod, and plate moving on the track until the boat is delivered safely to a specific place at a marina.

In a further embodiment, the present subject matter relates to a method for automatically docking a boat, the method comprising: providing a mooring device having a suction valve mounted to an arm, with the arm connected to a track via a rod and a plate; catching and holding the boat via the suction valve; rotating the arm 90 degrees; and moving the arm, the rod, and the plate along the track until the boat is delivered safely to a specific place at a marina.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
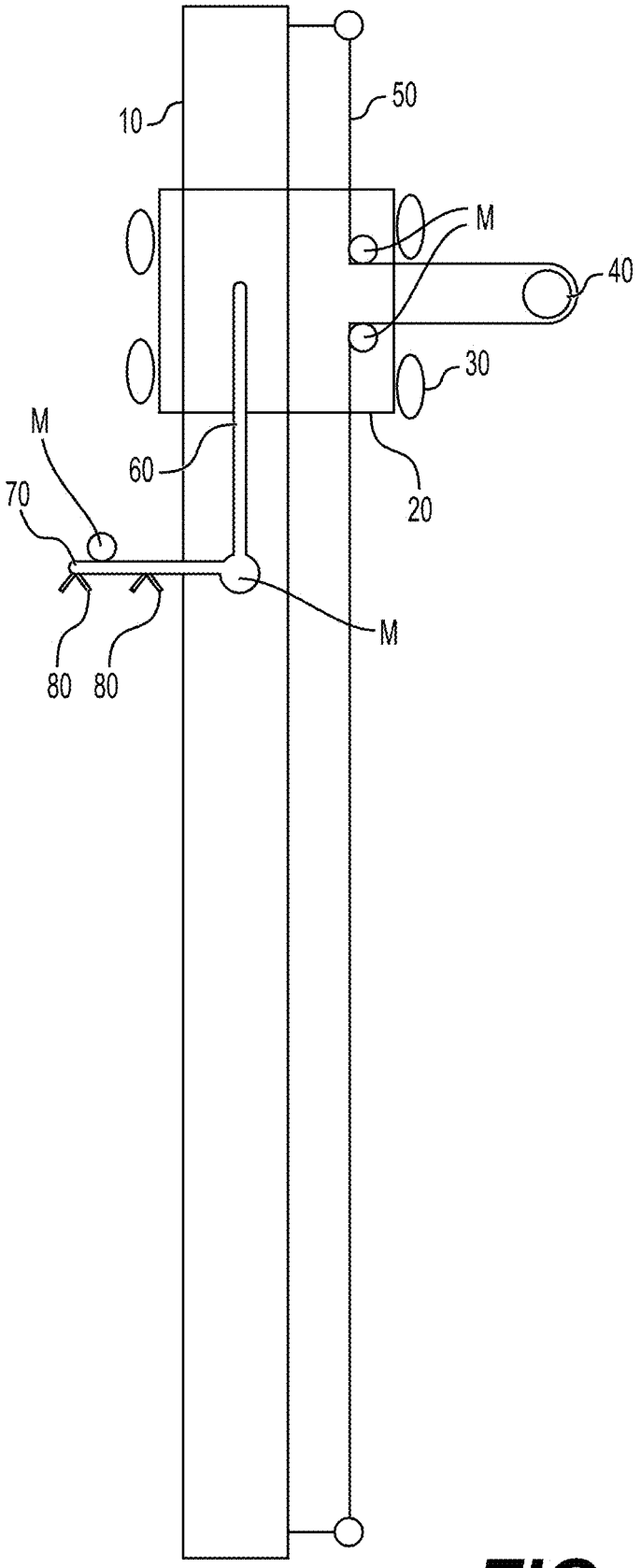
FIG. 1 shows a basic configuration for the device as described herein.

The following definitions are provided for the purpose of understanding the present subject matter and for construing the appended patent claims.

Definitions

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, size ranges, distance ranges, or the like, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Throughout the application, descriptions of various embodiments use "comprising" language. However, it will be understood by one of skill in the art, that in some specific instances, an embodiment can alternatively be described using the language "consisting essentially of" or "consisting of".

For purposes of better understanding the present teachings and in no way limiting the scope of the teachings, unless otherwise indicated, all numbers expressing quantities, percentages or proportions, and other numerical values used in the specification and claims, are to be understood as being modified in all instances by the term "about". Accordingly, unless indicated to the contrary, the numerical parameters set forth in the following specification and attached claims are approximations that may vary depending upon the desired properties sought to be obtained. At the very least, each numerical parameter should at least be construed in light of the number of reported significant digits and by applying ordinary rounding techniques.

The presently disclosed subject matter relates to an automated boat docking system solution to help boat drivers by saving time and effort, thereby protecting the boats from accidents.

In one embodiment, the present subject matter relates to an automated boat docking system having a mechanism installed at a marina or at a boat ramp. According to certain embodiments, the mechanism will have a rod installed, with a suction valve at the end of the rod. The suction valve is used to hold the boat in place. Once the suction valve is connected to the boat, the rod will move and rotate where the boat will be docked or lifted safely.

Mooring Device/Mechanism

In one embodiment, the present subject matter relates to a mooring device for automatically docking a boat, the mooring device comprising a suction valve mounted to an arm, or linear actuator, with the arm or linear actuator connected to a track, wherein the suction device catches and holds the boat, after which the arm rotates 90 degrees, followed by the arm and the boat moving on the track until the boat is delivered safely to a specific place at a marina.

In certain embodiments, the arm or linear actuator can have a diameter from about 10 to about 30 cm, about 15 to about 25 cm, or about 20 cm. In further embodiments, the rod can have a diameter of about 10 cm, about 11 cm, about 12 cm, about 13 cm, about 14 cm, about 15 cm, about 16 cm, about 17 cm, about 18 cm, about 19 cm, about 20 cm, about 21 cm, about 22 cm, about 23 cm, about 24 cm, about 25 cm, about 26 cm, about 27 cm, about 28 cm, about 29 cm, or about 30 cm.

In certain other embodiments, the rod can have a length of about 2 to about 5 m or about 3 to about 4 m. In further embodiments, the rod can have a length of about 2 m, about 2.5 m, about 3 m, about 3.5 m, about 4 m, about 4.5 m, or about 5 m.

In further embodiments, the track, or fixed track, can have a length of about 2 to about 5 m or about 3 to about 4 m. In further embodiments, the rod can have a length of about 2 m, about 2.5 m, about 3 m, about 3.5 m, about 4 m, about 4.5 m, or about 5 m.

The present mooring device is designed to automatically park a boat at a marina. Further, it can be used to raise the boat at a car trolley at the marina.

In certain embodiments, the mooring device can be placed at a boat ramp at a marina. In one embodiment, the mooring device can hold only one boat at a time. In certain embodiments, in use, the mooring device should be placed on a flat rigid surface. The device can be used such that the boat driver can bring the boat to the entry of the marina or the boat ramp, where the device will catch and park the boat automatically. The device can hold the boat and set it at a predetermined place, especially at the boat ramp where there may be high wind and high waves. Further, the device can "catch" the boat at any spot on the boat, so it does not require any specific device or features mounted on any specific point of the boat.

In certain embodiments, parts of the mooring device are able to withstand the salty water without corrosion or degradation. Further, the present device can work in wet, cold, and dusty weather.

In further embodiments, the mooring device runs on electricity. As such, electricity can be supplied to the device via batteries, solar panels, plugging into an electrical outlet, or using any other method for supplying electricity to the device.

In additional embodiments, the mooring device can be operated by remote control.

Referring to FIG. 1, the track 10 is fixed to the marina. On the track 10 is a plate 20 which can slide on the track 10 using the bearings 30. A pulley 40/belt 50 system can be used to move the plate 20 and bearings 30 across the track 10. The belt 50 can be fixed at each end of the track 10. The rod 60 is attached to the plate 20 and has an extended arm 70. A suction valve 80 which holds and moves the boat is attached at an end of the arm 70. The arm 70 can rotate 90 degrees.

In certain embodiments, a pulley 40 has a motor M fixed thereto, which can be used to move the plate, arm, and rod up and down the track, thereby moving the boat into the desired position. In one embodiment in this regard, the present system can contain three pulleys 40 attached to the plate 20, with one pulley 40 having a motor M affixed thereto and the other two pulleys 40 supporting the pulley 40 bearing the motor. In this configuration, since all pulleys 40 are affixed to the plate 20, the pulleys 40 and the plate 20 move the same distance along the marina. When the motor M starts to move the plate 20, the arm 70 holding the boat will also move, parking the boat in the designated position. Accordingly, the pulleys 40, belt 50, arm 70, rod 60, and plate 20 can all withstand any forces acting on the boat.

Figure 2A:
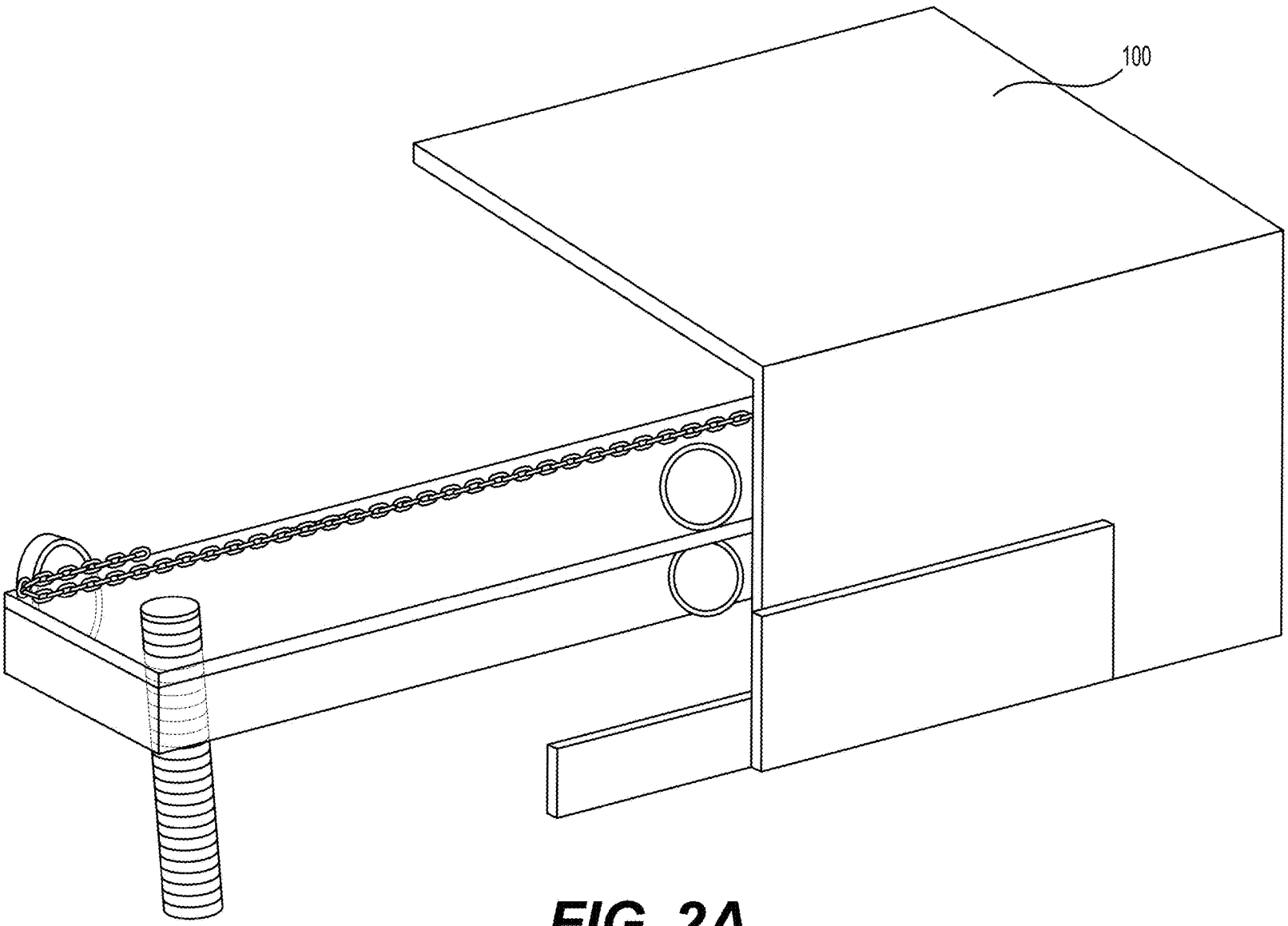
FIG. 2A shows a front side of a vertical configuration of the present system.
Figure 2B:
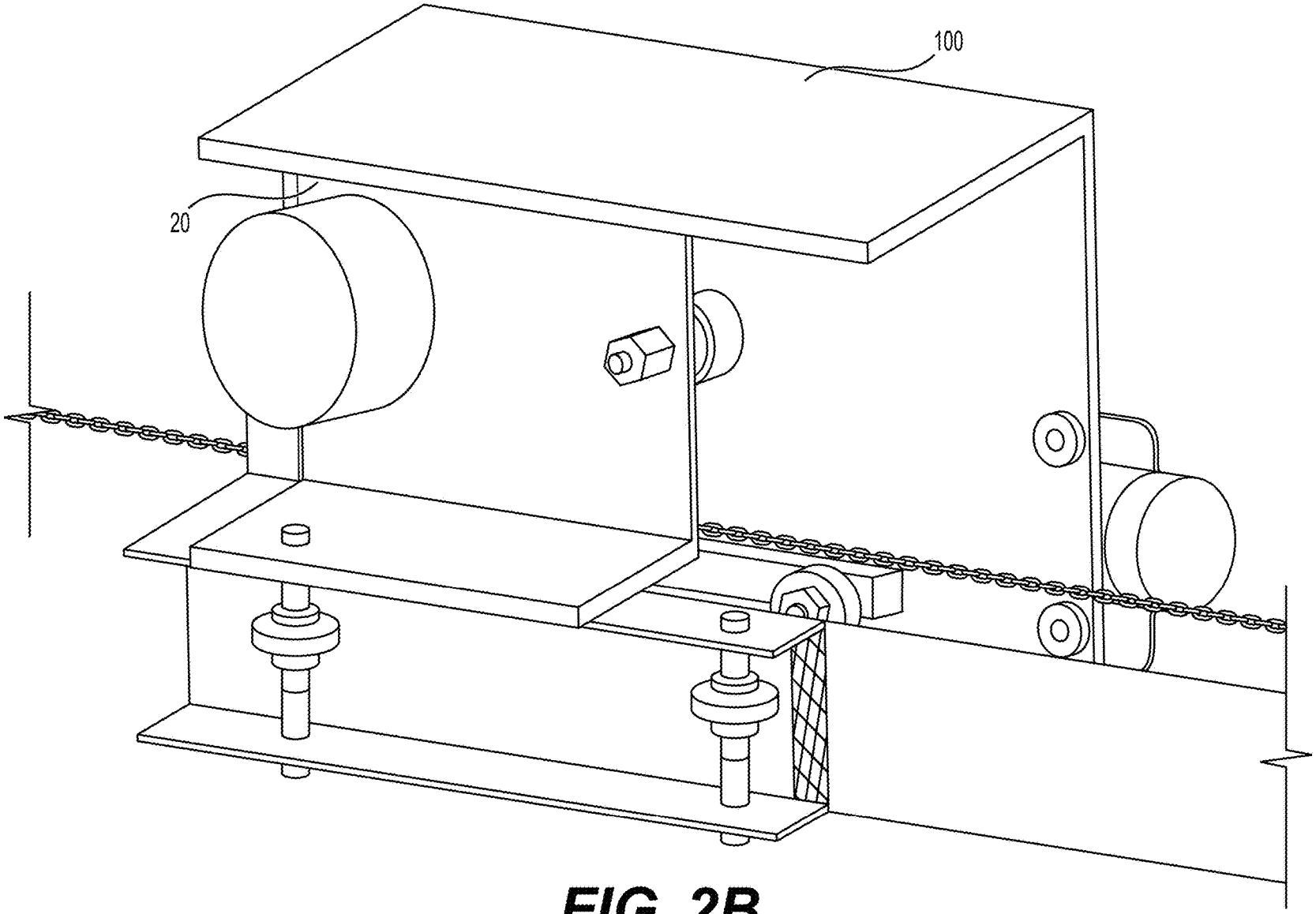
FIG. 2B shows a back side of a vertical configuration of the present system.

Referring to FIGS. 2A and 2B, FIG. 2A shows a front side of a vertical configuration of the present system, while FIG. 2B shows a back side of a vertical configuration of the present system. The system can have this vertical, rather than a horizontal, configuration to provide more space on a marina having a narrow width, thereby providing more space for people to walk on the marina. In this configuration, the track 10 is a square shaped track while the plate 20 has two bearings 30 on each side of the plate 20. The plate 20 can further include a holder 100 that extends a few meters out of the marina to catch the boat.

In certain embodiments, the track 10 can take the shape of an extruded hollow cube. In other embodiments, the track can have almost the same length as the marina. Further, since the bearings 30 move along the track 10, and the track 10 holds the plate 20 and the holder 100, the track 10 must be capable of bearing a high load. Accordingly, in certain embodiments, the track 10 can be made of aluminum. Further, the track can have two slots to support the entire mechanism on the marina.

In additional embodiments, each bearing 30 is used to slide along the track 10, thereby moving the other parts of the mechanism. In an embodiment, ball bearings will be used in the present mechanism. In certain embodiments, the entire mechanism can have two, four, or eight bearings 30. In other embodiments, each side of the track 10 having a cube shape has two bearings 30.

In further embodiments, the pulley 40 and belt 50 system can be used to move the plate 20. In this regard, the pulleys can be fixed on a small plate which is attached to the track 10. One of the pulleys 40 has a motor M that rotates and moves the entire mechanism.

In other embodiments, the holder 100 attached to the plate 20 can be used to support the arm 70 as it extends towards the boat. In certain embodiments, the holder can have an extruded L shape. It can further be used to support one or more motors motor M. Further the holder 100 and/or plate 20 can extend a few meters to catch the boat. In this event, the plate 20 and/or holder 100 can be attached to an extended liner, which can use a further motor motor M to extend the plate 20 and/or holder 200 to catch the boat.

In other embodiments, the arm 70, sometimes referred to as the suction arm, can rotate 90 degrees from the horizontal, and can be connected to the plate 20 via a rod 60. In certain embodiments, the arm 70 can have an extended V-shape. In other embodiments, the suction arm 70 can have a motor M attached thereto to permit the arm 70 to rotate. One or more suction valves 80 can be affixed to the arm 70 to catch and hold the boat. In certain embodiments, the suction valve(s) 80 can have a motor M to start the suction operation. In one embodiment, the arm 70 can include two suction valves 80, with one being used to suction air from the valve, the other being used to allow the entrance of air. By way of non-limiting example, the suction valves can be made from silicon, which can withstand various weather conditions.

In still further embodiments, any motors used in the present device can be DC motors. According to one configuration, the present device can have four motors M: one for the pulley 40 and belt 50 system, one for extending the extended liner, one for rotating the arm 70, and one for operating the suction valves 80. Each of these motors M can be 12V motors, except for the suction valve 80 motor M, which can be a 6V motor.

In additional embodiments, the electrical load used to operate the present mechanism can be supplied by a power supply. The power supply can typically be an electrical device that turns electrical current into electrical power. Various wires can be used to transmit electrical current.

EXAMPLES

Example 1

One iteration of the present devices was tested on a boat having a length of 39 ft, a height of 80 cm, and a width of 3 m. The dry weight of the boat without any engines or fuel was about 2.5 tons, or about 5.5 tons including the engines and fuel.

Similarly, the marina, according to this example, is able to accommodate boats having a length from 28 feet to 42 feet and a width of up to 4 m. The marina length was 11 m, while the distance for two boats to park was 10 m. In addition, the marina width was 2.2 m, and the was made of concrete having a of thickness 3 cm with a U-shape, where the concrete was stuffed by crock. Moreover, the marina had a depth of 55 cm for the boat to park.

Example 2

Figure 3:
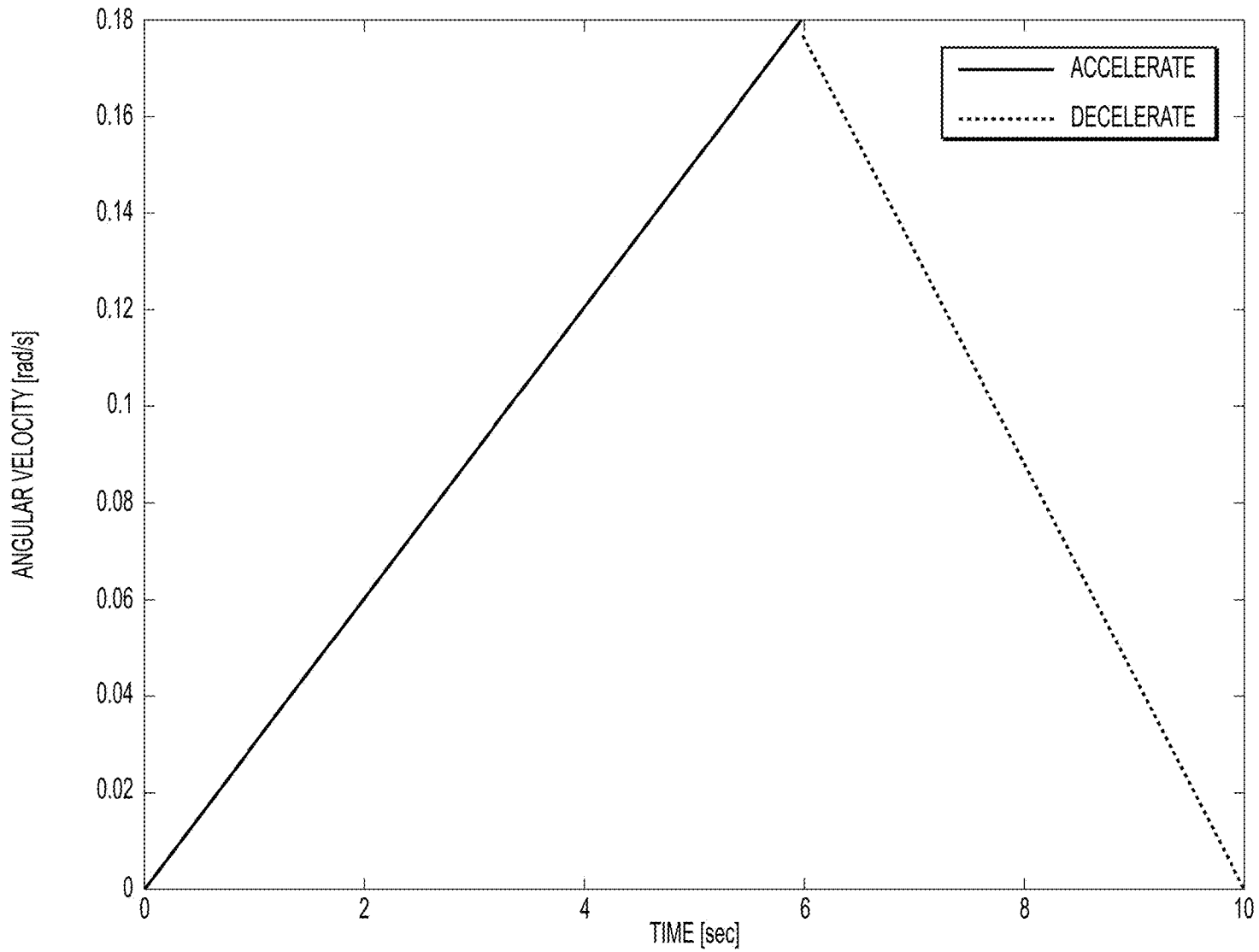
FIG. 3 shows a plot of angular velocity vs. time for the boat to determine required motor power value.

The rotating arm that holds the boat starts from rest with a zero initial angular velocity. After that, it accelerates until it reaches its maximum angular velocity of $\omega_{max}$, then it will decelerate. However, the most important area to obtain the required motor power value is the first area with the accelerating boat as seen in FIG. 3.

The total time that can be assumed for the boat to rotate is equal to 10 sec. However, the time for the arm to accelerate until it reaches its maximum angular velocity is equal to 6 sec. Also, the angular displacement of the boat equals to $$\frac{\pi}{3}[\text{rad/s}]$$

Therefore, the maximum angular velocity $\omega_{max}$ will be equal to:

$$\omega_{max} = \frac{\theta}{t_{ra}} = \frac{\pi/3}{6} = \frac{\pi}{18} = 0.175 \text{ rad/s}$$

The arm that holds the boat has a rectangular shape of width equal to 15 cm and length equal to 2 m. So, the moment of inertia of the arm at the center of gravity of the arm's mass is calculated below by taking the boat mass as the mass of the arm and neglect the real arm mass, with the mass of the boat equal to 3000 kg.

$$\omega_{max} = \frac{\theta}{t_{ra}} = \frac{\pi/3}{6} = \frac{\pi}{18} = 0.175 \text{ rad/s}$$

Figure 4:
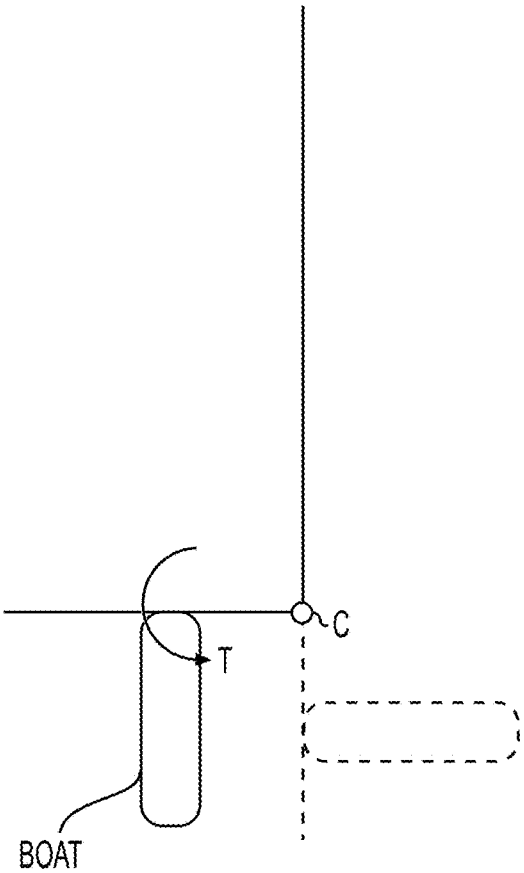
FIG. 4 shows the arm rotation about its edge which is point c.

The arm rotates about its edge which is point c as shown in FIG. 4, so the moment of inertia equals:

$$I = I_g + m_{boat}\left[\frac{L_{ra}}{2}\right]^2 = 335.21 + 3000\left[\frac{2}{2}\right]^2 = 3335.21 \ m^4$$

Using the constant acceleration equation with $t_{ra}$=6 sec and initial angular velocity $\omega_0$=0, the angular acceleration is obtained. Where the final angular velocity equal to the maximum angular velocity.

$$\omega_{max} = \omega_o + \ddot{\theta} t_{ra}$$

$$\ddot{\theta} = (\omega_{max} - \omega_o)/t_{ra} = (\omega_{max})/t_{ra} = 0.175/6 = 0.03 \text{ rad/s}^2$$

Figure 5:
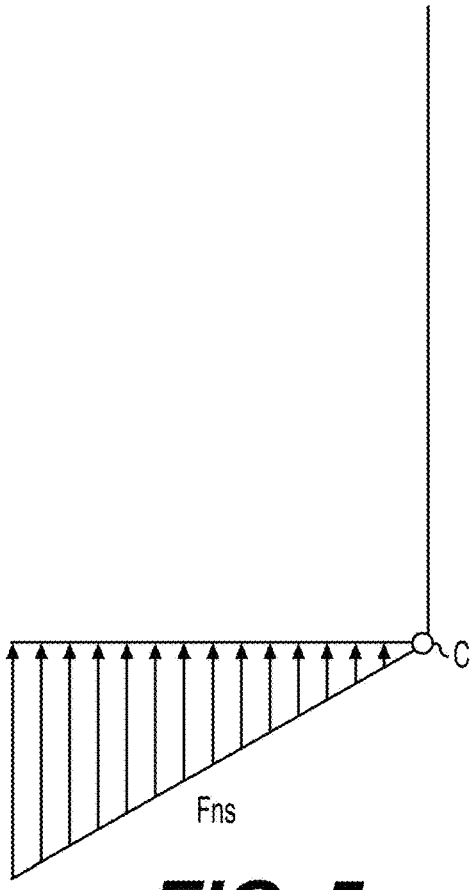
FIG. 5 shows the distributed drag force on the boat.
Figure 6:
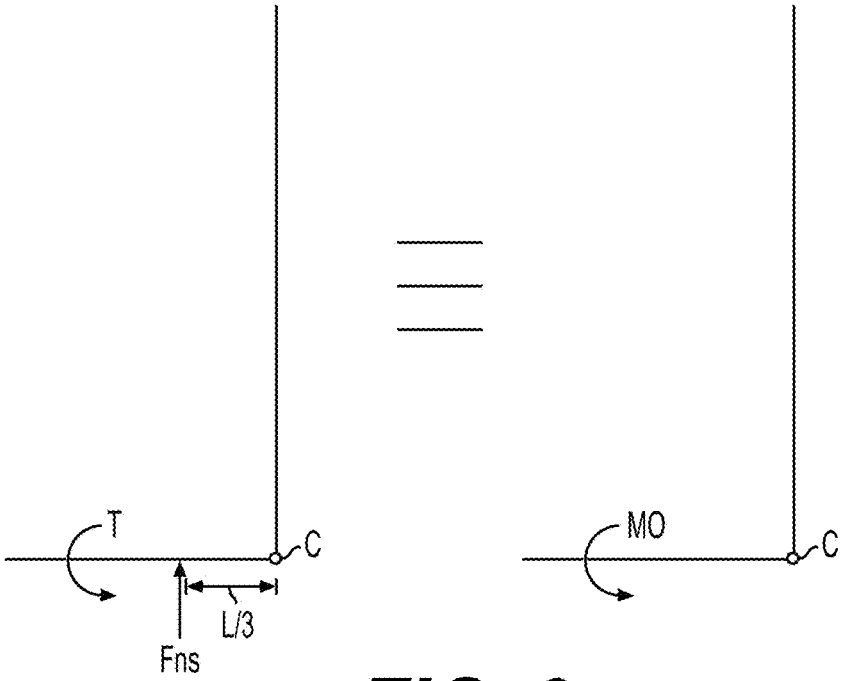
FIG. 6 shows a free body diagram of the arm.

The free body diagram of the boat with the rotating arm is shown in FIGS. 5 and 6, where the drag force on the side $F_{DS}$; from the wind and water is considered as a distributed load. In addition, the drag force values are calculated by using COMSOL. The following drag force values represent the resultant of the forces. Therefore, the drag force from the water is equal to 674 N and the drag force from the wind is equal to 468 N on the side. Therefore, the total drag force is equal to 1142 N. Also, the drag force can be concentrated on the arm at ⅓ of the base L from point c.

After that, Newton's second law for rotating body is used.

$$\sum M_c = I\ddot{\theta}$$

$$T_{ra} - F_{Ds}\left(\frac{L_{ra}}{3}\right) = I\ddot{\theta}$$

Therefore, the required torque is equal to:

$$T_{ra} = I\ddot{\theta} + F_{Ds}\left(\frac{L}{3}\right) = 3335.21 * 0.03 + 1142\left(\frac{2}{3}\right) = 880 \ N \cdot m$$

Finally, the power can be obtained by the following equation:

$$P_{ra} = T_{ra}\omega_{max} = 880 * 0.175 = 160 \ W|$$

Example 3

The plate that drags the arm and the boat has pulleys for the linear motion on the track. The track extends along the marina. After the arm that holds the boat rotates, the plate starts to move. Therefore, the plate accelerates until it reaches the maximum velocity. After that, the plate moves the boat at a constant speed before it starts to decelerate, as shown in FIG. 7.

Figure 7:
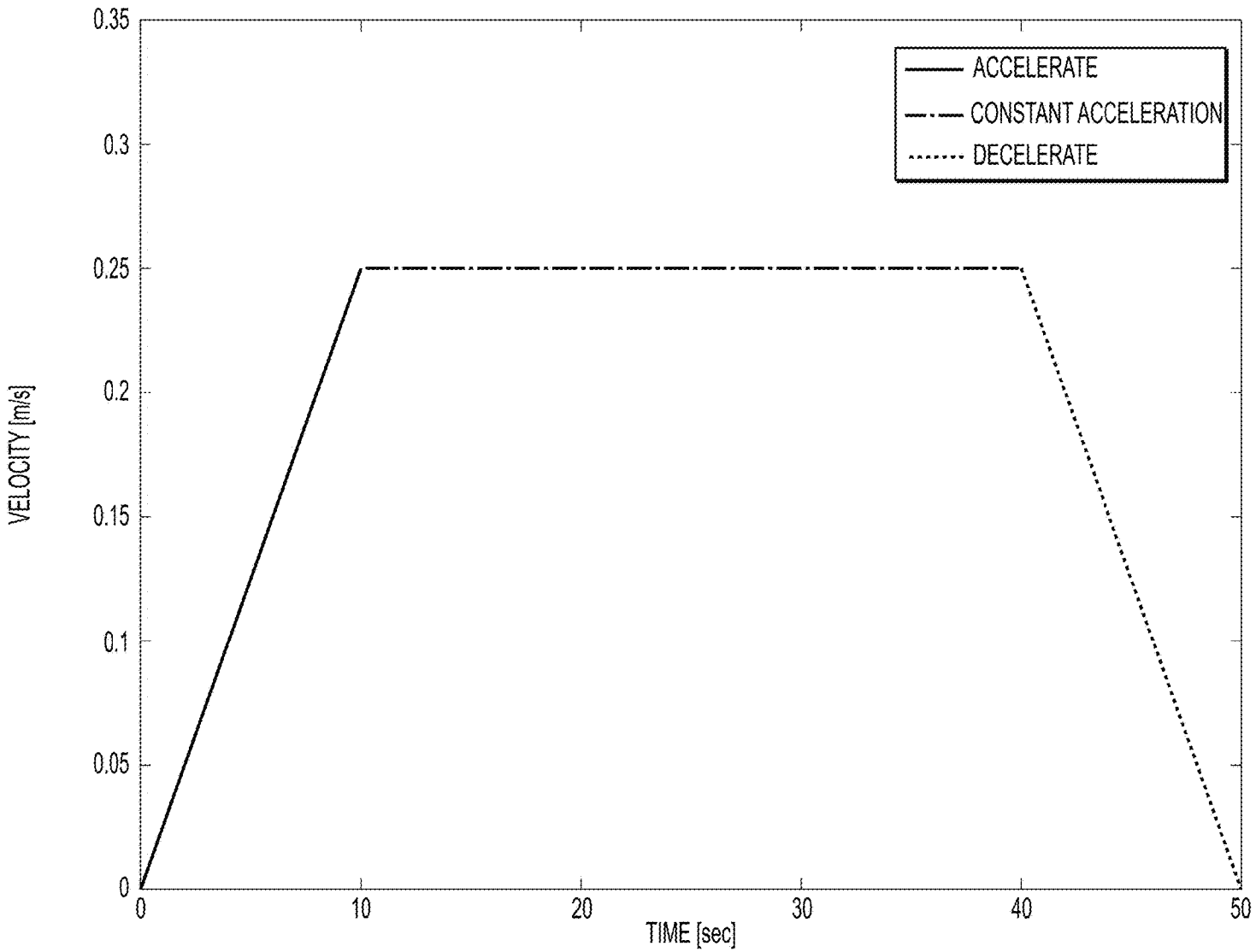
FIG. 7 shows a plot of boat velocity vs. time once the boat is attached to the present mechanism.

The first area in FIG. 7 that represents the acceleration process is the most important area. Therefore, the distance to accelerate $d_d$ and the time $t_d$ from zero initial velocity to the maximum velocity are equal to 2.5 m and 10 sec, respectively. However, the total distance that the boat can travel is equal to 10 m and the total time for dragging is equal to 50 sec.

$$v_{max} = \frac{d_d}{t_d} = \frac{2.5}{10} = 0.25 \ m/s$$

The acceleration is obtained by using the constant acceleration equation, where the initial velocity $v_0$ is equal to zero, the final velocity is equal to the maximum velocity and the time is equal to 10 sec.

$$v_{max} = v_o + at_d$$

$$a = \frac{v_{max} - v_o}{t_d} = \frac{0.25 - 0}{10} = 0.025 \ m/s^2$$

While the boat is being dragged, the drag force on the front part $F_{Df}$ is in the opposite direction of the acceleration and it is equal to 63 N. However, it is equal to the summation of the drag force from the water and the wind, which is equal to 28 N and 35 N, respectively.

Newton's second law is used to calculate the required force to withdrawal the boat $F_d$, where the mass is considered as the boat mass moat and it is equal to 3000 kg.

$$\sum F = m_{boat}a$$

$$F_d - F_{Df} = m_{boat}a$$

$$F_d = m_{boat}a + F_{Df} = 3000 * 0.025 + 63 = 140 \ N$$

Therefore, the power for the motor is equal to:

$$P_d = F_d v_{max} = 140 * 0.25 = 35\text{W}$$

Example 4

There are three pulleys to drag the boat with a radius equal to $r_p$=6 cm. The first pulley which it at the top of the plate has the motor for dragging. The two pulleys at the bottom of the plate are used to support the motor pulley, the belt, and to keep the same tension $T_b$ for the belt, in this case, a transmission belt. The tension in the belt should be greater than or equal to the force that is required to withdrawal the boat $F_d$.

$$T_b \geq F_d$$

$$T_b \geq 140 \text{ N}$$

Example 5

To rotate the screw to extend the liner that catches the boat, a motor is required. Therefore, the power of the motor is equal to the power of the screw, in watts. The diameter of the screw can be estimated by using the buckling equation. Therefore, Per represents the critical force, and it is equal to the weight of the boat while the small parts weights such as the liner and the bolts are neglected. Moreover, $P_{cr}$ will have the value of 117.7 kN by using factor of safety equal to 4.

$$P_{cr}=m_{boat}*g=3000*9.81=29430 \text{ N}$$

$$P_{cr}=29430*n_s=29430*4=117.7 \text{ kN}$$

The length of the screw can be represented by l; and it is equal to 1.2 m. Moreover, C is the end condition constant, and it is equal to 1.2 (recommended value). By taking mild steel for the screw, the modulus of elasticity $E_S$ equals 210 GPa. Therefore, the minimum screw's diameter $d_{min}$ is equal to 3 cm, by using the buckling equation for the screw.

$$d_s = \left(\frac{64\ P_{cr} l_s^2}{\pi^3 C E_s}\right)^{\frac{1}{4}} = \left(\frac{64 * 117.7 * 1000 * 1.2^2}{\pi^3 (1.2)(210 * 10^9)}\right)^{\frac{1}{4}} = 0.034 \text{ m} \approx 3 \text{ cm}$$

After that, the screw will have a diameter of 3 cm and a pitch p equal to 0.5 mm.

The screw was square threaded with pitch equal to 0.5 mm and major diameter of 3 cm. So, the mean diameter $d_m$ is equal to:

$$d_m = d_s - \frac{\rho}{2} = 3 - \frac{0.05}{2} = 2.975 \text{ cm}$$

The threaded friction f for the steel is 0.25, and the force F is equal to the drag force.

$$F=F_{DS}:=1142 \text{ N}$$

In the rising torque equation l represents the lead. So, the rising torque is calculated for different lead values. Therefore, the rising torque of the screw can be evaluated by the following equation:

$$T_R = \frac{Fd_m}{2}\left(\frac{\pi f d_m - l_s}{\pi d_m + f l_s}\right)$$

For a Single Threaded Screw:

$$l_1 = 0.5 * 1 = 0.5 \text{ mm}$$

-continued $$T_R = \frac{Fd_m}{2}\left(\frac{\pi f d_m - l_1}{\pi d_m + f l_1}\right) = \frac{1142 * 29.75}{2}\left(\frac{\pi * 0.25 * 29.75 - 0.5}{\pi * 29.75 + 0.25 * 0.5}\right) = 4.15\ N \cdot m$$

For a Double Threaded Screw:

$$l_2 = 0.5 * 2 = 1 \text{ mm}$$

$$T_R = \frac{Fd_m}{2}\left(\frac{\pi f d_m - l_2}{\pi d_m + f l_2}\right) = 4.05\ N \cdot m$$

For a Triple Threaded Screw:

$$l_3 = 0.5 * 3 = 1.5 \text{ mm}$$

$$T_R = \frac{Fd_m}{2}\left(\frac{\pi f d_m - l_3}{\pi d_m + f l_3}\right) = 3.95\ N \cdot m$$

Then, the screw will be single threaded by taking the largest value of the rising torque which is equal to 4.15 N.m. The distance that the screw moves is equal to 1 m in 10 sec. So, the velocity is calculated by the following equation:

$$v_l = \frac{d_l}{t_l} = \frac{1}{10} = 0.1 \text{ m/s}$$

The angular velocity ω of the screw is shown below with a radius equal to half of the major diameter:

$$\omega_s = \frac{v_l}{r_s} = \frac{0.1}{0.015} = 6.7 \text{ rad/s}$$

Therefore, the power of the screw is displayed below:

$$P_S=T_R\omega_S=4.15*27.8 \text{ W}$$

The condition of self-locking is also satisfied as shown below:

$$\pi f d_m > l_s$$

$$\pi*0.25*0.2975>0.5*10^{-3}$$

$$0.234 \geq 0.0005$$

Example 6

There are two critical types of bolts used to maintain the parts of the mechanism together.

For the first bolt, threaded fasteners such as bolts are used to maintain the motors with the holder. Moreover, washers are added to have a good surface finish and to reduce the stress concentration. The size of the bolt should be safe. Therefore, the stiffness of the bolts and members are calculated below. The members have a compression force, while the bolts have a tension force. The minimum bolt size is M10×35.

The washer is metric plain 10R, so it has a thickness of 4 mm. The grip represents the total thickness, so it is equal to:

$$l_{grip}=t_{holder}+t_{motorbase}+t_{washer}$$

$$l_{grip}=10+10+4=24 \text{ mm}$$

The nut thickness H is equal to 8.4 mm. Faster length $L_b$ must satisfy the following condition:

$$L_b \geq l_{grip} + H$$

$$L_b \geq 32.4$$

Therefore, the fastener length L is rounded up and is equal to 35 mm. The following equations are used:

$$\text{Threaded length } L_T = 2d + 6 = 2 * 10 + 6 = 26 \text{ mm}$$

$$\text{Length of unthreaded portion in grip } l_d = L_b - L_T = 35 - 26 = 9 \text{ mm}$$

$$\text{Length of threaded portion in grip } l_t = l_{grip} - l_d = 24 - 9 = 15 \text{ mm}$$

$$\text{Area of unthreaded portion } A_d = \pi d^2 / 4 = 78.53 \text{ mm}^2$$

Hence, the bolt stiffness can be evaluated by the following equation where $E_b$ is equal to 210 GPa for mild steel:

$$k_b = \frac{A_d A_t E_b}{A_d l_t + A_t l_d} = 562.66 \text{ MN/m}$$

The equation below (see appendix) is used to find the frustum of a hollow cone of the compressed members. Where t is the member thickness, $d_b$ is the bolt diameter, and D is the diameter where it depends on the member's location.

Washer:

$$D_{washer} = 1.5 * d_b = 1.5 * 10 = 15 \text{ mm}$$

$$t_{washer} = 4 \text{ mm}$$

$$k_{washer} = \frac{0.5774\pi E_b d_b}{\ln\frac{(1.155t_{washer} + D_{washer} - d_b)(D_{washer} + d_b)}{(1.155t_{washer} + D_{washer} + d_b)(D_{washer} - d_b)}}$$

$$k_{washer} = \frac{0.5774\pi(210)(10)}{\ln\frac{(1.155(4) + 15 - 10)(15 + 10)}{(1.155(4) + 15 + 10)(15 - 10)}} = 7846 \text{ MN/m}$$

Holder:

$$D_{holder} = 15 + 2 * 10 * \tan(30) = 26.55 \text{ mm}$$

$$t_{holder} = 10 \text{ mm}$$

$$k_{holder} = \frac{0.5774\pi E_b d_b}{\ln\frac{(1.155t_{holder} + D_{holder} - d_b)(D + d_b)}{(1.155t_{holder} + D_{holder} + d_b)(D - d_b)}} = 14890 \text{ MN/m}$$

Motor Base:

$$D_{motorbase} = 1.5 * d_b = 1.5 * 10 = 15 \text{ mm}$$

$$t_{motorbase} = 10 \text{ mm}$$

$$k_{motorbase} = \frac{0.5774\pi E_b d_b}{\ln\frac{(1.155t_{motorbase} + D_{motorbase} - d_b)(D_{motorbase} + d_b)}{(1.155t_{motorbase} + D_{motorbase} + d_b)(D_{motorbase} - d_b)}} = 4654 \text{ MN/m}$$

After that, applying the previous equation to all members. Then, finding the equivalent stiffness.

$$k_m = \left(1/k_{washer} + 1/k_{holder} + 1/k_{motorbase}\right)^{-1} = 2424 \text{ MN/m}$$

Bolts Stresses $S_p$ is the proof strength, which is 225 MPa.

$F_i$ is the preload and it is considered for non-permanent joint.

$$F_i = 0.75 * A_t * S_p = 0.75 * 58 * 225 * 10^{-3} = 9.8 \text{ kN}$$

The Stiffness Constant C:

$$C_s = \frac{k_b}{k_b + k_m} = \frac{562.66}{562.66 + 2424} = 0.19$$

where P is weight of the 2 kg motor, and N is the number of bolts which is 4 bolts.

The Yielding Factor of Safety:

$$n_p = \frac{S_p A_t}{\frac{C_s P}{N} + F_i} = \frac{225 * 58}{0.19 * 2 * \frac{9.81}{4} + 9.8 * 1000} = 1.33$$

The Load Factor of Safety (See Appendix):

$$n_t = \frac{S_p A_t - F_i}{\frac{C_s P}{N}} > 10$$

The Joint Separation Factor of Safety (See Appendix):

$$n_{\square} = \frac{F_i}{\frac{P}{N}(1 - C_s)} > 10$$

The load factor of safety and the joint separation factor of safety are above 10. It is acceptable because these bolts are provided in the shop with acceptable cost.

For the second bolt, there are shear stresses on the bolts that hold the belt holder with the track. The type of these bolts is considered as M5×20 with property class of 4.6. Where $S_{yb}$ is the yield strength of the bolt. $S_{yb}$ is the yield shear strength of the bolt. The diameter of the bolt is 5 mm, and the maximum force is the tension of the belt which is equal to 140 N, and the number of bolts is 2. Also, the area is the cross-section area of the bolt.

$$S_{xyb} = 0.577 S_{yb} = 0.577 * 240 = 138.5 \ MPa$$

$$T_{maxb} = \frac{F_{maxb}}{A_s} = \frac{F_{maxb}/N}{\frac{\pi}{4} * d_{hb}^2} = \frac{140/2}{\frac{\pi}{4} * S^2} = 3.6 \ MPa$$

Therefore, the factor of safety due to direct shear is:

$$n_{ax} = S_{syb}/T_{maxb} = 38$$

Bearing on Bolts:

$$\sigma_b = \frac{F_{maxb}}{A_s} = \frac{F_{maxb}/N}{d_{hh} * t} = \frac{140/2}{5 * 10} = 1.4 \ MPa$$

Therefore, the factor of safety due to bearing on bolts is:

$$n_b = S_{yb}/T_{maxb} = \frac{138.5}{3.6} = 38.5$$

Bearing on Members:

The yield strength of the member $S_{ym}$ is 34 MPa.

$$\sigma_m = \frac{F_{maxb}/N}{d_{bb}t} = \frac{140/2}{5*10} = 1.4\ MPa$$

$$n_m = S_{ym}/\sigma_m = \frac{34}{1.4} = 24$$

The factors of safety due to shear on bolts, bearing on bolt, and bearing on member are all above 10. So, it is safe with acceptable and provided bolts in the shop.

Example 7

The arm rotates the boat from 0° to to 90° t where it resists a drag force of 11851.93 N. To ensure the safety of the arm, COMSOL Multiphysics were used. For the analysis, the fixed constraint was on the upper screw. Also, a boundary load was s applied on the bottom screw. The boundary load is due to the weight of the boat on the water and the drag force.

The Properties for this Component are:

Material: Aluminum Alloy 1100 Annealed

Young's modulus=69 GPa

Poisson's ratio=0.33

Yield strength=34 MPa

The boundary load for this part is around 11851.93 N. After the analysis, it was noticed that the maximum von mises stress was around 4.882 MPa. This value is lower than the yield strength of the aluminum which means this component is safe. The safety factor equals 6.964 which is considered to be good and reasonable since aluminum is light in weight, reliable, can adapt easily to outdoor designs and is available in the workshop. Thus, it is safe and convenient to use this material for the arm.

Example 8

The track pulls the boat into the marina by rotating the bearing on the track. To ensure the safety of the track, COMSOL Multiphysics was used. For the analysis, the fixed constraint was on the edges of the track. Also, a boundary load was applied on the side of the track. The boundary load was due to the contact bearing, the shear, and the weight on the track.

The Properties for this Component Track:

Material: Aluminum Alloy 1100 Annealed

Young's modulus=69 GPa

Poisson's ratio=0.33

Yield strength=34 MPa

Stress Analysis

The boundary load for this part is around 207.62 N. It was noticed that the maximum von mises stress is around 0.0921 Pa. This value is very lower than the yield strength of the aluminum which means this component is safe. The safety factor is above 10 which is considered to be very good and reasonable since aluminum is light in weight, reliable, can adapt easily to outdoor designs, and available in the workshop. Thus, it is safe and convenient to use this material for the track.

Example 9

The holder is one of the main components that hold motor, liner, and small motor. When represent the acting force on the holder due to the weight of motors a linear throw the joint, for the analysis the bottom face was assumed to be fixed.

The Properties for this Component are:

Material: Aluminum Alloy 1100 Annealed

Youngs modulus=69 GPa

Poisons ratio=0.33

Yield strength=34 MPa

Stress Analysis:

It was noticed that maximum Von mises analysis was around 3.896 MPa. This value means this component is safe and safety factor equals to 8.725 which considered to be good and reasonable since aluminum is light in weight, reliable and available in the workshop.

It is to be understood that the devices, mechanisms, systems, and methods as described herein are not limited to the specific embodiments described above, but encompass any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A mooring device for automatically docking a boat at a marina, the mooring device comprising:

at least one suction valve mounted to a midpoint on a first side of an arm;

a rod with a first end and a second end where the first end of the rod is connected to a plate at said first end; and a track, wherein the arm is connected to the rod at the second end of the rod on a second side of said arm opposite where the at least one suction valve is mounted to the arm, wherein the at least one suction valve is configured to catch and hold the boat, the arm is configured to horizontally rotate 90 degrees, after which the arm, rod, and plate are configured to move on the track until the boat is delivered safely to a specific place at the marina.

2. The mooring device as recited in claim 1, wherein said arm is configured to horizontally rotate 90 degrees after catching and holding the boat via the at least one suction valve.

3. The mooring device as recited in claim 1, wherein said arm has a diameter of about 10 to about 30 cm.

4. The mooring device as recited in claim 1, wherein said rod has a length of about 2 to about 5 m.

5. The mooring device as recited in claim 1, wherein the track has a length of about 2 to about 5 m.

6. The mooring device as recited in claim 1, wherein the mooring device is configured for placement at a boat ramp at the marina.

7. The mooring device as recited in claim 1, wherein the mooring device can be operated by remote control.

8. The mooring device as recited in claim 1, wherein the plate slides on the track using bearings.

9. The mooring device as recited in claim 8, further comprising a pulley and belt system to move the plate and bearings across the track.

10. The mooring device as recited in claim 9, wherein the track has two ends, and the belt is fixed at each end of the track.

11. The mooring device as recited in claim 9, wherein a first motor is fixed to a pulley in the pulley and belt system.

12. The mooring device as recited in claim 1, wherein the plate is attached to a holder that extends the plate to catch the boat.

13. The mooring device as recited in claim 12, wherein one or more of the track, plate, holder, arm, and rod is made of aluminum.

14. The mooring device as recited in claim 1, wherein the arm has a second motor attached thereto to horizontally rotate the arm 90 degrees.

15. The mooring device as recited in claim 1, wherein the suction valve has a third motor attached thereto to create a suction.

16. A method for automatically docking a boat at a marina, the method comprising:

providing a mooring device having at least one suction valve mounted to an arm, with the arm connected to a track via a rod and a plate;

catching and holding the boat via the suction valve;

horizontally rotating the arm 90 degrees; and moving the arm, the rod, and the plate along the track until the boat is delivered safely to a specific place at the marina.

17. The method as recited in claim 16, wherein a pulley and belt system is used to move the arm, the rod, and the plate along the track.

18. The method as recited in claim 16, further comprising a holder extending the plate to catch the boat.

19. The method as recited in claim 16, further comprising lifting the boat once it is safely delivered to a specific place at the marina.

* * * * *